United States Patent [19]

Koda et al.

[11] Patent Number: 4,999,546

[45] Date of Patent: Mar. 12, 1991

[54] STARTING DEVICE FOR DISCHARGE TUBE

[75] Inventors: Yoshiharu Koda; Tadashi Takashima, both of Tokyo, Japan

[73] Assignee: Kabushiki Kaisha Denkosha, Tokyo, Japan

[21] Appl. No.: 346,651

[22] Filed: May 3, 1989

[30] Foreign Application Priority Data

Jan. 30, 1989 [JP] Japan ..... 1-17591
Mar. 10, 1989 [JP] Japan ..... 1-56068

[51] Int. Cl.[5] ..... H05B 37/02

[52] U.S. Cl. ..... 315/225; 315/307; 315/323; 315/DIG. 5; 315/DIG. 7

[58] Field of Search ..... 315/209 R, 225, 291, 315/307, DIG. 4, DIG. 5, DIG. 7, 313, 323

[56] References Cited

U.S. PATENT DOCUMENTS

| | | | |
|---|---|---|---|
| 4,137,484 | 1/1979 | Osteen | 315/209 R |
| 4,663,570 | 5/1987 | Luchaco et al. | 315/DIG. 4 |
| 4,749,914 | 6/1988 | Feher et al. | 315/246 |

FOREIGN PATENT DOCUMENTS

| | | |
|---|---|---|
| 0271396 | 6/1988 | European Pat. Off. . |
| 2657824 | 7/1977 | Fed. Rep. of Germany . |
| 3233655 | 5/1983 | Fed. Rep. of Germany . |
| 59-175598 | 10/1984 | Japan . |
| 63-18797 | 2/1988 | Japan . |

*Primary Examiner*—Robert J. Pascal

*Attorney, Agent, or Firm*—Gordon W. Hueschen

[57] ABSTRACT

For a starting device to acquire an ability to start a discharge tube efficiently, allow the light from the discharge tube to be regulated effectively over a wide range, and fit versatile use with discharge tubes of a varying kind, this invention causes the frequency of pulses of a fixed duty ratio issued by pulse generating means to be freely adjusted by adjusting means and consequently enables high-voltage applying means to apply a high voltage of a frequency proper for the pulses to the discharge tube and effect efficient and stable start of the discharge tube. Since the frequency of high voltage for application to the discharge tube is adjusted by the adjusting means, the regulation of light is attained over a wide range and the starting device itself is enabled to fit versatile use with discharge tubes of a varying kind. For the starting device employed for starting a plurality of discharge tubes to enjoy a sufficient reduction in weight and volume, sequential potential forming means serves the purpose of sequentially actuating a plurality of high-voltage applying means and consequentially enabling the plurality of discharge tubes to be sequentially started. Thus, the starting device is enabled to start the plurality of fluorescent discharge tubes with the aid of one set of power source and rectifying means. It is, therefore, no longer necessary to use as many power sources and rectifiers as the discharge tubes. Thus, this invention materializes reduction in weight, volume, and cost.

9 Claims, 7 Drawing Sheets

Characteristics of starting frequency and illuminance in using 40-W linear type fluorescent discharge tube Characteristics of power consumption and illuminance in using 40-W linear type fluorescent discharge tube

STARTING DEVICE FOR DISCHARGE TUBE

BACKGROUND OF THE INVENTION

1. Field of the Invention

This invention relates to a starting device for lighting a discharge tube, particularly a fluorescent discharge tube. More particularly, this invention relates to a starting device which is capable of not only efficiently lighting a discharge tube of varying kind but also allowing adjustment of light over a wide range which, when used for lighting a plurality of discharge tubes, enables the individual discharge tubes to be sequentially started and consequently aids in attaining the purpose of decreasing weight, compacting structure, and lowering cost.

2. Description of the Prior Art

Generally, the fluorescent discharge tube in the course of actual service exhibits a property of refusing to start discharge unless a voltage several times the voltage used during a continued discharge is applied at the time of starting discharge and a negative property of retaining the voltage between the opposite terminals closely to a fixed magnitude during the continuous discharge in spite of an increase in feed current. The fluorescent discharge tube, therefore, requires a starting device which is provided with a function of applying between the opposite terminals a voltage exceeding the voltage of the continued discharge at the time of starting discharge and a function of regulating the current flowing to the fluorescent discharge tube and, at the same time, stabilizing the incoming current so as to overcome a possible variation in the voltage of the power source after the start of discharge.

Most of the starting devices for discharge tubes currently in popular use make direct use of commercial frequency power source. In terms of operating principle, those of small capacity start a fluorescent discharge tube by means of a glow lamp and a choke coil (stabilizer) and those of medium or large capacity instantaneously start a fluorescent discharge tube by virtue of the actions of a heater circuit and a high-voltage circuit incorporated in a special winding wrapped round a stabilizer. Very recently, starting devices which incorporate an electronic circuit therein and start a fluorescent discharge tube by virtue of the high-frequency voltage issued by the electronic circuit as disclosed in the specification of Japanese Utility Model Application Disclosure SHO 63(1988)-18,797 have been finding general acceptance.

In the conventional starting devices described above, however, those of small capacity requires use of a choke coil of relatively large capacity because they are adapted to light a fluorescent discharge tube with the aid of a glow lamp. Thus, they attain a desired reduction in size and weight only with great difficulty. By the same token, those of medium to large capacity allow the reduction only with extreme difficulty. Any attempt at conferring such a highly advanced function as regulation of light upon any of the conventional starting devices is substantially impracticable on account of the characteristic construction of the device. It has been difficult to materialize the regulation of light and consequently efficient start of the fluorescent discharge tube.

Further in the case of the starting device which incorporates an electronic circuit therein as described above, the regulation of light mentioned above is attained to some extent. When one and the same device is relied on to effect the regulation of light stably and, at the same time, allow efficient start of the discharge tube, the range over which the stable regulation of light is obtained is not very wide.

Further, the conventional starting devices are adapted to serve exclusively for fluorescent discharge tubes of their own allocations. When they are manufactured at a factory, for example, they must be produced in numerous types including those for exclusive use with 40-W linear type fluorescent discharge tubes and those for exclusive use with 20-W circular type fluorescent discharge tubes.

When the conventional starting devices are relied on each to light a plurality of discharge tubes, it becomes necessary for the plurality of discharge tubes to be severally provided with a starting device or to be furnished collectively with a power source and a rectifying circuit both large in size and capacity, with the result that the entire system suffers from an addition to size and an increase in power consumption. Further, the rush current of a large magnitude which occurs at the time of starting exerts a load on inner circuit elements. The repetition of this exertion of the load possibly entails disruption of such circuit elements and eventual failure of the device. This attempt, therefore, proves to be highly disadvantageous in terms of weight, capacity, cost, power consumption, etc.

SUMMARY OF THE INVENTION

This invention aims to provide a starting device for a discharge tube which overcomes the various problems suffered by the conventional starting devices as described above. The first object of this invention is to provide a starting device for a discharge tube, which effects efficient start of the discharge tube, allows regulation of light over a wide range, and serves effectively for the discharge tube without reference to the kind of discharge tube.

The second object of this invention is to provide a starting device for a discharge tube, which enables a plurality of discharge tubes to be started without requiring installation of as many power sources, rectifying devices, etc. as the discharge tubes being started and, therefore, enjoys the merits of light weight, compactness, and economy.

DETAILED DESCRIPTION OF THE INVENTION

Now, the present invention for the fulfillment of the first object mentioned above will be described in detail below. In preparation for this description and for the purpose of facilitating the comprehension of the invention, the essence of this invention will be explained with reference to FIG. 1.

Figure 1:
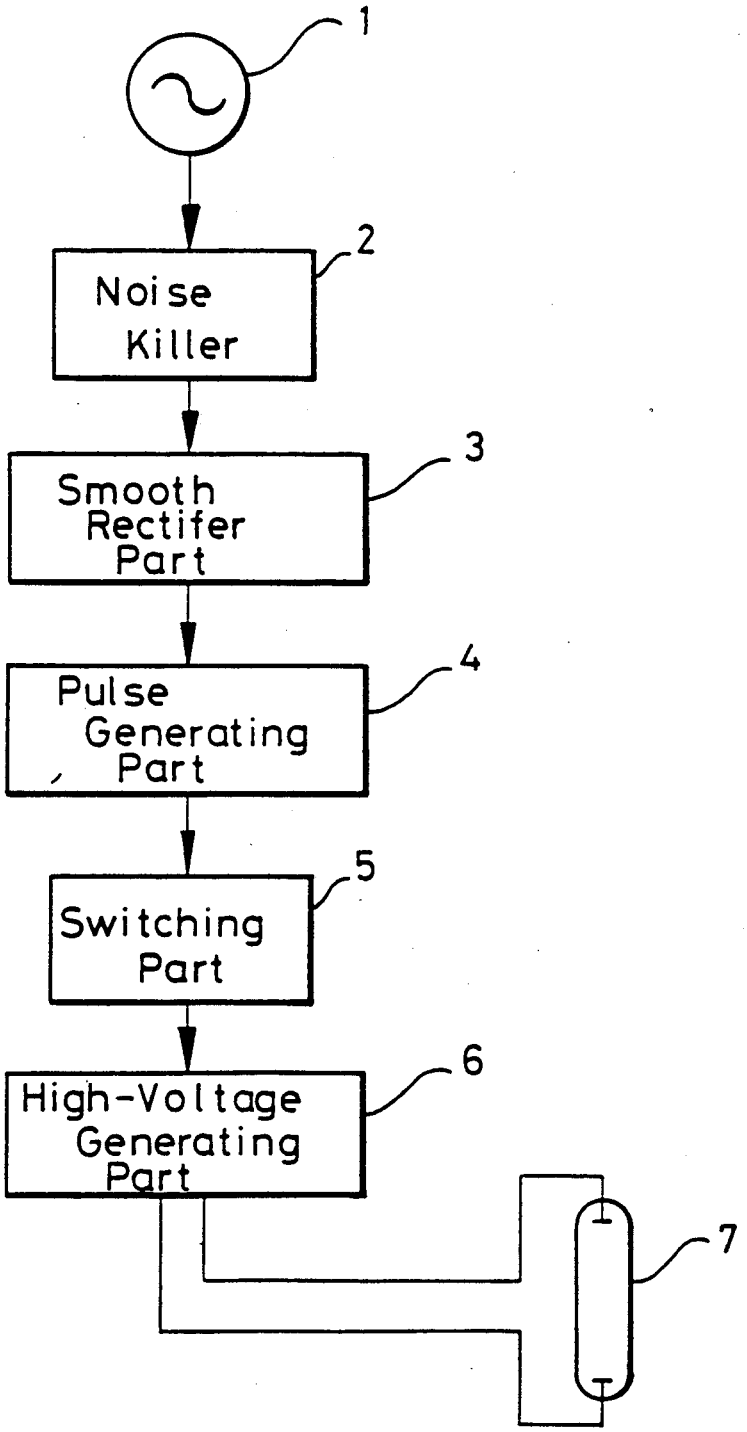
FIG. 1 is a block diagram illustrating the configuration of a starting device for a discharge tube contemplated by the present invention for the fulfillment of the first object described above.

FIG. 1 is a block diagram illustrating the schematic configuration of the starting device for a discharge tube according to the present invention.

This diagram depicts a starting device for a discharge tube, which is adapted to rectify an AC voltage supplied from an AC power source into a DC voltage, form pulses of a fixed duty ratio based on the DC voltage, supply a high-voltage power corresponding to the pulses to a fluorescent discharge tube, and consequently effect efficient and stable start of the fluorescent discharge tube. Further, this starting device for the discharge tube allows regulation of light to be effected without a sacrifice of illuminance because it is capable of adjusting the frequency of pulses with the duty ratio retained on a constant level.

As illustrated in the diagram, a noise killer 2 for intercepting the noise coming from an AC power source 1 or preventing the noise generated by the starting device from being injected into the AC power source is connected to the AC power source 1. To the noise killer 2 is connected a smooth rectifier part 3, i.e. rectifying means for converting an AC voltage supplied from the AC power source 1 into a stable DC voltage suffering from a very small ripple. A pulse generating part 4 serving as pulse generating means which is to be driven by the DC voltage issued from the smooth rectifier part 3 is connected to the smooth rectifier part 3. This pulse generating part 4 performs a function of generating high-frequency pulses of a fixed duty ratio. The pulses generated by the pulse generating part 4 are such that the frequency thereof is freely adjusted by an adjusting element (not shown) which is connected to the pulse generating part 4. To this pulse generating part 4 is connected a switching part 5 adapted as switching means for producing a switching motion synchronized with the high-frequency pulses issued from the pulse generating part 4. This switching part 5 is adapted to control the operation of a high-voltage generating part 6 which is high-voltage applying means for applying high voltage to a fluorescent discharge tube 7. This high-voltage generating part 6, at the time of starting the fluorescent discharge tube 7, effects this starting by applying a very high voltage between the opposite terminals of the fluorescent discharge tube 7 and, while the fluorescent discharge tube 7 is in the state of continuous discharge, fulfills the function of a stabilizer for enabling the fluorescent discharge tube to produce continuous discharge stably.

Owing to the configuration described above, the AC voltage supplied from the AC power source 1 is deprived of noise by the noise killer 2 and rectified into a DC voltage by the smooth rectifier part 3. The pulse generating part 4, on receiving the DC voltage, forms pulses of a frequency freely set based on a fixed duty ratio and supplies these pulses to the switching part 5. The switching part 5 operates the high-voltage generating part 6 as synchronized with the pulses. The high-voltage generator 6 supplies a high-voltage power synchronized with the pulses to the fluorescent discharge tube 7 and sets this fluorescent discharge tube glowing. The light from the fluorescent discharge tube 7 can be regulated by adjusting the frequency of the pulses formed by the pulse generating part 4. As the result, the fluorescent discharge tube 7 can be efficiently and stably started and kept aglow.

Now, a typical starting device for a discharge tube as one embodiment of this invention using the configuration depicted above will be described in detail below with reference to FIG. 2.

Figure 2:
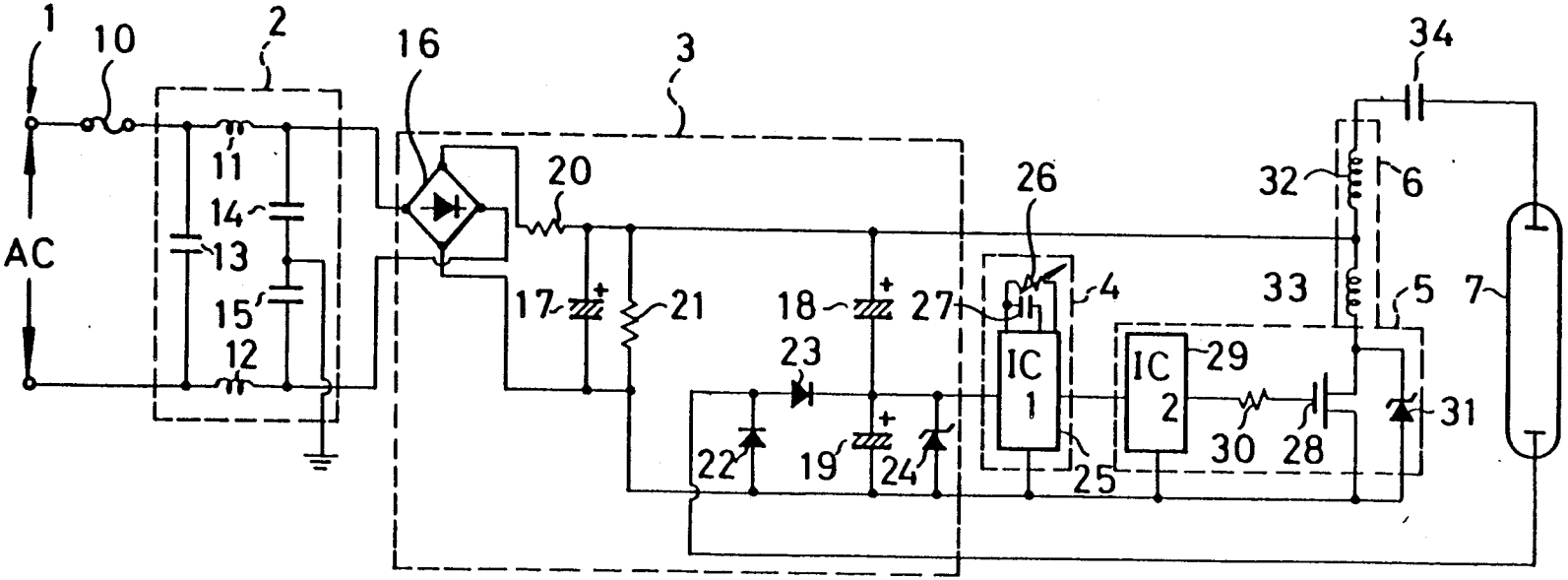
FIG. 2 is a diagram illustrating circuits which make up the starting device for a discharge tube as the first embodiment of the present invention.

FIG. 2 is a diagram specifically illustrating a circuitry of the starting device for a discharge tube according to this invention.

As illustrated, the noise killer 2 shown in FIG. 1 is connected via a fuse 10 to the AC power source 1. This noise killer 2 is a band-pass filter which is composed of noise-removing coils 11 and 12 and noise-removing capacitors 13, 14, and 15.

The noise killer 2 ensures stable operation of the starting device and protection of the peripheral devices against the adverse effects of noise by preventing the high-frequency switching noise generated by the switching part 5 in consequence of its own switching operation from flowing back to the AC power source or by intercepting the high-frequency noise from the AC power source.

To this noise killer 2 is connected the aforementioned smooth rectifier part 3, which is composed of a rectifier 16 for effecting all-wave rectification of the AC voltage issued from the noise killer 2, smoothing capacitors 17, 18, and 19 for smoothing the all-wave rectified ripple-rich DC voltage, and rush current inhibiting resistor 20 for precluding the adverse effects of a rush current, a bleeder resistor 21, rectifying diodes 22 and 23, and a constant-voltage diode 24.

First, the DC voltage which has undergone the all-wave rectification effected by the rectifier 16 having a bridge circuit formed of diodes or thyristors is smoothed chiefly by the rectifying capacitor 17. The voltage to be applied to the astable multivibrator which will be described more specifically hereinafter is produced by the rectifying capacitors 18 and 19. To the astable multivibrator, the split voltage of the rectifying capacitor 19 is applied. The constant-voltage diode 24 serves to restrict the potential of the split voltage so as to prevent the astable multivibrator from exposure to any unduly high voltage.

Figure 3A:
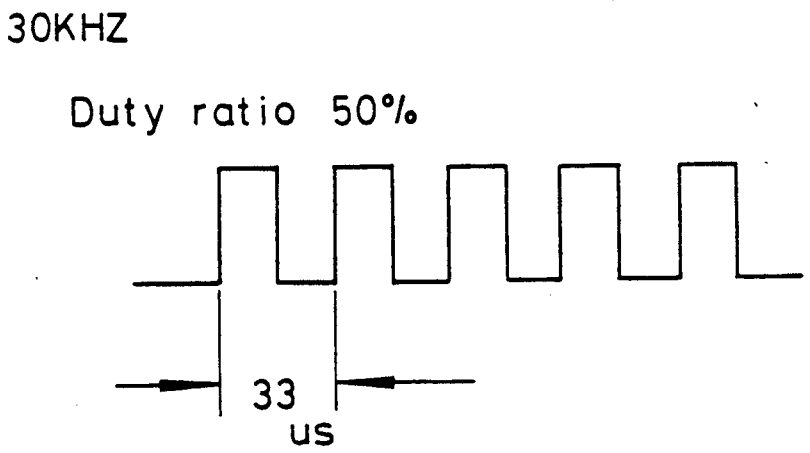
FIG. 3A and 3B are diagrams illustrating typical high-frequency pulses issued from an astable multivibrator illustrated in FIG. 2.
Figure 3B:
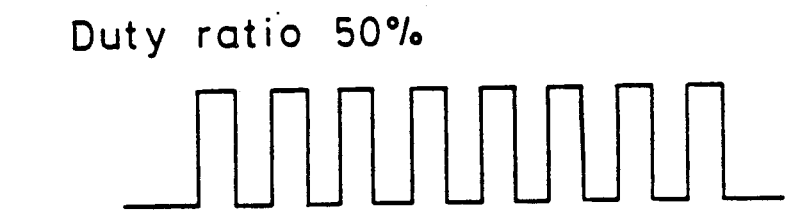

The DC voltage which is produced by the smooth rectifier 3 as described above is fed out to the pulse generating part 4. This pulse generating part 4 is composed of an astable multivibrator 25 for issuing high-frequency pulses of a fixed duty ratio and a variable resistor 26 and a capacitor 27 connected to the astable multivibrator 25 and adapted to adjust the frequency of the high-frequency pulses issued from the astable multivibrator 25. The variable resistor 26 and the capacitor 27 jointly form adjusting means. The astable multivibrator 25 used in this embodiment is an ordinary commercially available IC with the code of CD4047B. From this astable multivibrator 25 are issued high-frequency pulses whose duty ratio is set at 50% as illustrated in FIG. 3A and FIG. 3B, for example, in accordance with the magnitudes of resistance and capacity respectively of the variable resistor 26 and the capacitor 27 and whose frequency is set freely by the variable resistor 26. Thus, the astable multivibrator 25 is enabled by varying the magnitude of resistance of the variable resistor 26 to issue high-frequency pulses of a varied frequency with a fixed duty ratio of 50%.

The high-frequency pulses issued from the astable multivibrator 25 as described above are supplied to the switching part 5. This switching part 5 is composed of a field effect transistor (FET) 28, an FET driving IC 29 serving to issue switching signals for driving the field effect transistor 28, an overcurrent preventing resistor 30 for protecting the field effect transistor 28 against the adverse effects of an overcurrent possibly issued from the FET driving IC 29 for one cause or other, and a surge absorber 31 for protecting the field effect transistor 28 against a surge voltage.

The FET driving IC 29 serves the purpose of synchronizing the high-frequency pulses issued from the astable multivibrator 25 with the high-frequency pulses of its own and forming switching signals of a prescribed voltage capable of driving the field effect transistor 28. Similarly to the astable multivibrator 25, the FET driving IC 29 is an ordinary commercially available IC with the code of CD4050B.

The switching signals formed by this FET driving IC 29 are forwarded via a resistor 30 and injected to the gate terminal of the field effect transistor 28 and used in switching the field effect transistor 28 as synchronized with the high-frequency pulses mentioned above.

Further, to the drain terminal of this field effect transistor 28 is connected an autotransformer 6, i.e. the high-voltage generating part composed of windings 32 and 33. This autotransformer 6 is adapted to form a high voltage in accordance with the switching motion mentioned above and applies this high voltage via capacitor 34 capable of inhibiting the DC fraction of the high voltage to the fluorescent discharge tube 7 and consequently starts the fluorescent discharge tube 7. To be specific, the field effect transistor 28 is adapted to operate synchronously with the high-frequency pulses issued from the astable multivibrator 25 and cause the autotransformer 6 to apply the high voltage to the fluorescent discharge tube 7 in accordance with the switching motion of the field effect transistor 28.

The starting device of this invention for a discharge tube configured as described above operates as follows.

The AC voltage supplied from the AC power source 1 and deprived of noise by the noise killer 2 is transformed by the smooth rectifier part 3 into a corresponding DC voltage. As the DC voltage actuates the astable multivibrator 25 forming part of the pulse generating part 4, the astable multivibrator 25 issues high-frequency pulses whose frequency is freely set by the variable resistor 26. The high-frequency pulses which are issued in this case are pulses whose duty ratio is set at 50% as illustrated in FIG. 3A and FIG. 3B.

Then, the high-frequency pulses are fed out to the FET driving IC 29 forming part of the switching part 5. The FET driving IC 29 transforms these high-frequency pulses into switching signals of a prescribed voltage capable of driving the field effect transistor 28. By the supply of these switching signals to the field effect transistor 28, the field effect transistor 28 is caused to produce a switching motion and the autotransformer 6 is consequently caused to issue a high voltage for setting the fluorescent discharge tube 7 glowing.

In other words, the frequency of the high voltage supplied to the fluorescent discharge tube 7 is determined by the switching motion of the field effect transistor 28 and this switching motion is determined by the frequency to be set in the astable multivibrator 25 by the variable resistor 26. As the result, the frequency of the high voltage supplied to the fluorescent discharge tube 7 can be adjusted and the light from the fluorescent discharge tube 7 can be regulated by adjusting the variable resistor 26.

Now, the results of a test performed on the regulation of light from the fluorescent discharge tube 7 by the use of the variable resistor 26 will be described with reference to FIG. 4 and FIG. 5.

Figure 4:
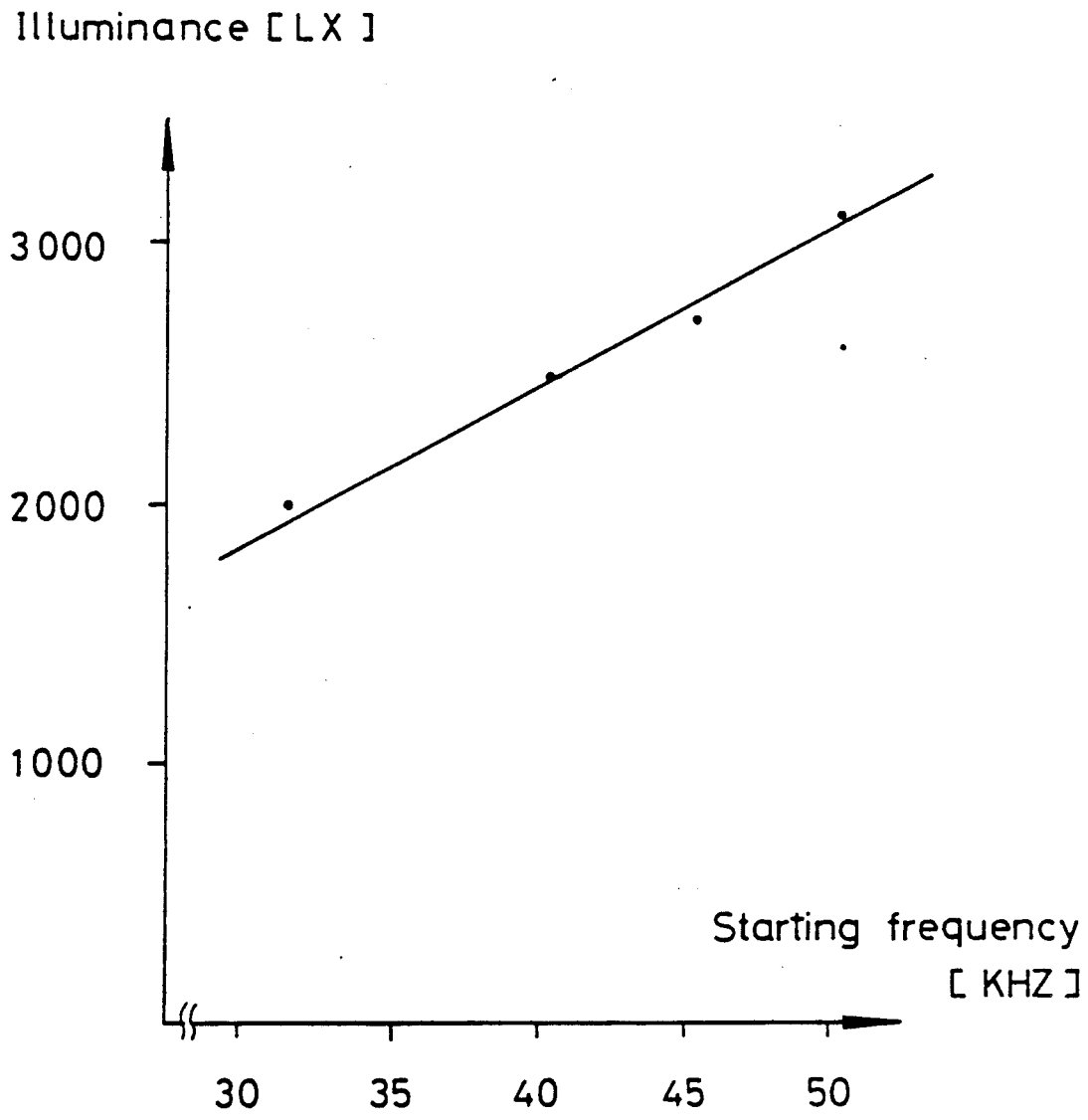
FIG. 4 is a diagram showing the characteristics of starting frequency and illuminance observed when a fluorescent discharge tube is started with the circuitry illustrated in FIG. 2.
Figure 5:
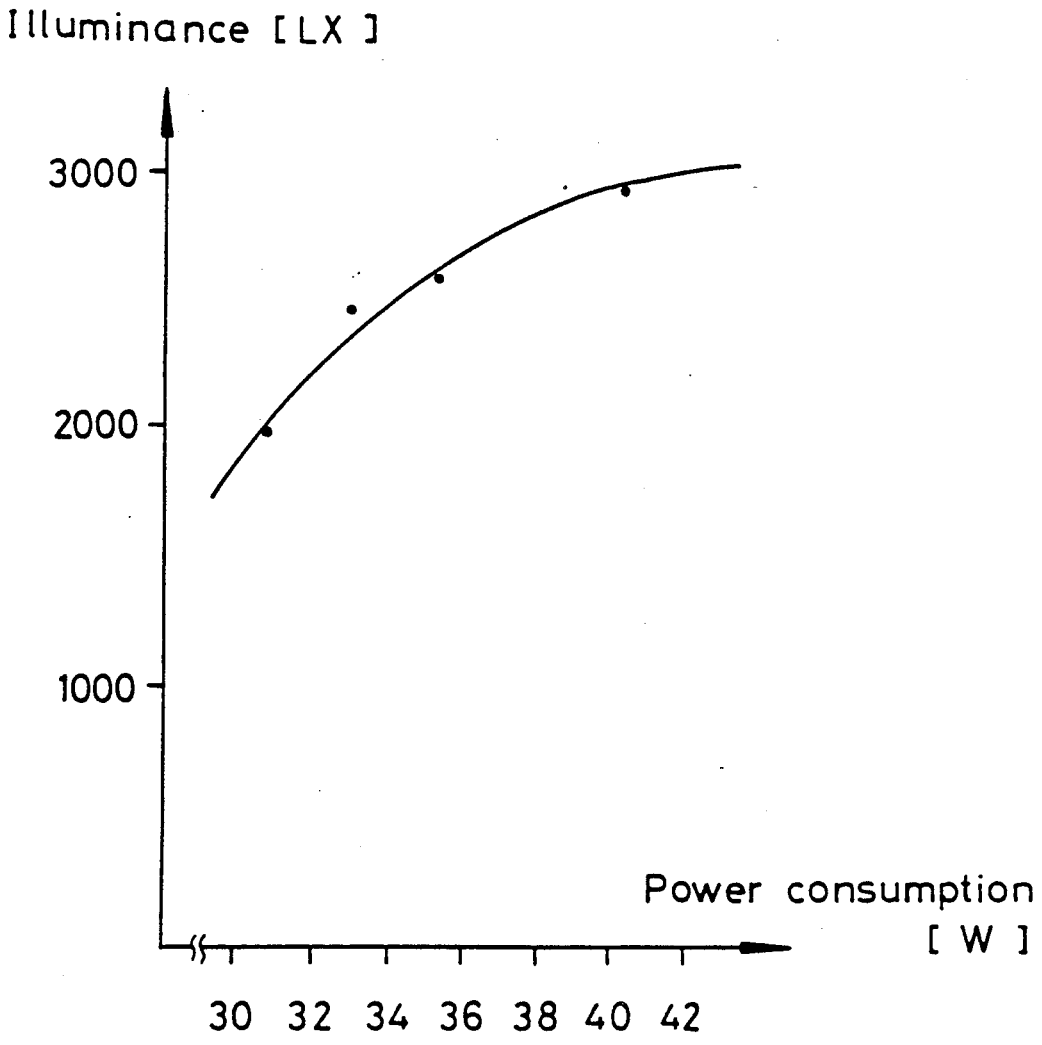
FIG. 5 is a diagram showing the characteristics of power consumption and illuminance observed when a fluorescent discharge tube is started with the circuitry illustrated in FIG. 2.

FIG. 4 is a diagram showing the characteristics of starting frequency and illuminance observed when the circuitry of the present embodiment described above was used in starting a 40-W linear type fluorescent discharge tube.

As illustrated in the diagram, the starting frequency of the high-frequency pulses adjusted by the variable resistor 26 and issued from the astable multivibrator 25 is in proportion to the illuminance of the fluorescent discharge tube 7. In the experiment which produced this characteristic diagram, the data of the graph were obtained by varying the frequency of the high-frequency pulses issued from the astable multivibrator 25 by the adjustment of the magnitude of resistance of the variable resistor 26 from 30 KHz to 50 KHz measuring the illuminance of the fluorescent discharge tube at the varying frequency with the aid of an illuminance meter. In this experiment, while the frequency was varied over a wide range and the illuminance was given a relatively large width, the fluorescent discharge tube 7 was allowed to vary its illuminance while retaining a highly stable lighting. In other words, the regulation of light was effected stably over a very wide range. It is because the duty ratio of the high-frequency pulses was maintained at a constant magnitude and only the frequency was allowed to vary that the regulation of light could be effected stably over the wide range. When the regulation of light is effected by varying the duty ratio, the time required for supply of the voltage for application to fluorescent discharge tube 7 is greatly shortened in consequence of a decline in the illuminance due to the regulation of light as compared with the time for suspending the supply of the voltage and this notable decrease of the time deprives the discharge of its stability. In contrast, when the regulation of light is effected by varying the frequency and not the duty ratio as in the present invention, the discharge is stably maintained because the ratio of the time for supply of the voltage for application to the fluorescent discharge tube 7 to the time for suspending the supply of the voltage is fixed without reference to the magnitude of illuminance.

Now, the characteristic of power consumption observed during the regulation of light of the fluorescent discharge tube 7 performed in the same manner as described above will be described below with reference to FIG. 5.

In the diagram are shown the characteristics of power consumption and illuminance observed when a 40-W linear type fluorescent discharge tube was actually started by the use of the circuitry described in the present embodiment.

As illustrated in the diagram, the power consumption and the illuminance have a curvilinear correlation. In the experiment which produced this characteristic diagram, the data of the graph were obtained by varying the frequency of the high frequency pulses issued from the astable multivibrator approximately from 30 KHz to 50 KHz by the adJustment of the magnitude of resistance of the variable resistor 26 and measuring the illuminance at the varying power consumption with the aid of an illuminance meter. Also in this experiment, the fluorescent discharge tube was allowed to produce stable lighting over a wide range of the illuminance for the same reason as given above. It is, therefore, logical to conclude that the starting device of the present invention is capable of starting a multiplicity of fluorescent discharge tubes different in capacity. When the starting device of this invention is to be used as means for starting a 20-W fluorescent discharge tube, for example, it can be finished as a starting device exclusively for use with the 20-W discharge tube by adjusting the variable resistor 26 during the course of its manufacture thereby setting the magnitude of its resistance at a prescribed level. When the starting device is to be used as means for starting a 40-W fluorescent discharge tube, it can be finished exclusively for use with the 40-W discharge tube by similarly setting the magnitude of resistance of the variable resistor 26 at a prescribed level. In actuality, however, the autotransformer 6 is required to possess a large capacity when the allowable capacity of the fluorescent discharge tube intended for versatile application is set over an unduly wide range, when this autotransformer 6 of the large capacity is used with a fluorescent discharge tube of a small capacity, there ensues the possibility that the large capacity of the autotransformer 6 is not utilized economically. It is therefore inferred that the desirable capacity of the fluorescent discharge tube for versatile application ranges approximately from 15 W to 40 W. When this variable resistor 26 is furnished externally with another variable resistor capable of adjusting the magnitude of resistance thereof within a range of certain width, the versatility of application can be materialized as coupled with the regulation of light from the fluorescent discharge tube 7.

The specific numerical values of power consumption, magnitude of current, starting frequency, and illuminance which were obtained as data in the aforementioned experiment were as shown below. For the collection of these data, a 40-W fluorescent discharge tube was used.

| Power consumption (W) | Current (A) | Starting frequency (KHz) | Illuminance (LX) |
|---|---|---|---|
| 30.5 | 0.580 | 32.36 | 2000 |
| 32.5 | 0.606 | 41.22 | 250O |
| 35.0 | 0.643 | 46.36 | 2700 |
| 39.5 | 0.715 | 51.20 | 3000 |

The present invention has been described as relying on an astable multivibrator to serve as means for pulse generation. The pulse generating means need not be limited to the astable multivibrator but may be selected freely from among all contrivances which are capable at all of generating high-frequency pulses. As the switching means, the field effect transistor has been mentioned, for example. Again it is naturally permissible to employ any of all contrivances which are capable at all of producing a switching motion in response to the incoming pulses.

In the starting device for a discharge tube in the present embodiment which enables the frequency of the high voltage for application to the fluorescent discharge tube 7 to be adjusted and the regulation of light from the fluorescent discharge tube to be consequently effected by the adjustment of the variable resistor 26, the regulation of light can be performed stably because it is accomplished by the adjustment of the frequency. When the regulation of light is carried out in the manner described above, therefore, the fluorescent discharge tube can be started and retained aglow efficiently. Further the regulation of light performed in this manner is attained over a wide range, depending on the range of variation of the variable resistor 26. Thus, the fluorescent discharge tube 7 can be stabilized over a wide range and the light therefrom can be regulated efficiently. Since the starting device allows adjustment of the frequency of high voltage for application to the fluorescent discharge tube, it is usable with a wide variety of fluorescent discharge tubes 7 having different capacities. It is, therefore, no longer necessary to manufacture as many kinds of starting devices as the fluorescent discharge tubes 7. This fact contributes greatly to improving the productivity of the starting device. Further, the regulation of light mentioned above can be attained simply by adjusting the variable resistor 26 during the course of manufacture thereof, for example, and this adjustment is an extremely easy operation. Thus, the starting device enjoys improved operational efficiency and warrants all the more enhanced productivity.

Figure 6:
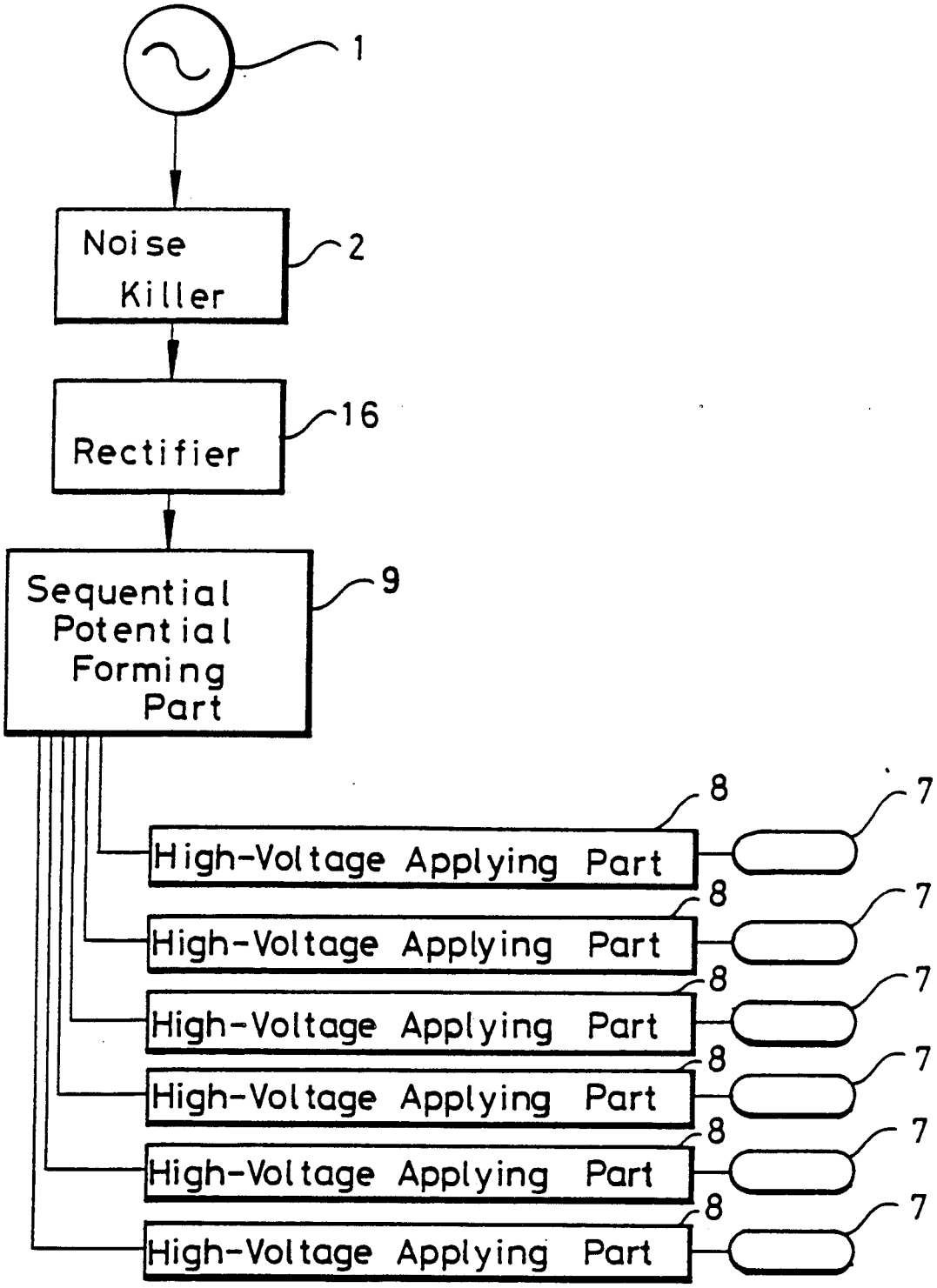
FIG. 6 is a block diagram illustrating the configuration of a starting device for a discharge tube contemplated by the present invention for the fulfillment of the second object described above.

Now, the embodiment of this invention for fulfilling the second object mentioned above will be described in detail below with reference to FIG. 6 and FIG. 7.

First, to facilitate the comprehension of this invention, the essence of the invention will be described below with reference to the block diagram of FIG. 6 which illustrates schematically the configuration of the starting device for a discharge tube according to the present invention.

In this diagram is illustrated a starting device capable of starting a plurality of fluorescent discharge tubes with the aid of a set of power source and rectifying means by rectifying the AC voltage supplied from the AC power source into a DC voltage and sequentially starting the plurality of fluorescent discharge tubes by virtue of the DC voltage.

As illustrated in the diagram, the noise killer 2 adapted to intercept the noise issuing from the AC power source 1 or prevent the noise generated by the starting device from being injected into the AC power source 1 is connected to the AC power source 1 similarly to the preceding embodiment. To this noise killer 2 is connected the rectifier 16 adapted to serve as rectifying means for rectifying the AC voltage supplied from the AC power source 1 and transforming it into a DC voltage. This rectifier 16 is further adapted to feed out the rectified DC voltage to the sequential potential forming part 9 serving as a sequential potential forming means. This sequential potential forming part 9 is possessed of a plurality as many output terminals as the fluorescent discharge tubes 7 given to be started. It is adapted to generate sequentially stated potentials at the output terminals, in response to the DC voltage received from the rectifier 16. To the output terminals, high-voltage applying parts 8 serving as high-voltage applying means corresponding to the individual fluorescent discharge tubes 7 are connected. These high-voltage applying parts 8 are adapted to apply proper high voltages to the relevant fluorescent discharge tubes 7 whenever the output terminals are brought up to the stated potentials, to start the fluorescent discharge tubes 7.

Owing to the configuration described above, the AC voltage supplied from the AC power source 1 is deprived of noise by the noise killer 2 and rectified into a DC voltage by the rectifier 16. The sequential potential forming part 9, in response to the DC voltage consequently received, sequentially generates stated potentials at the individual output terminals. The high-voltage applying parts 8 severally connected to the output terminals, in the order in which the respective output terminals acquire the stated potentials, supply high-voltage powers to the fluorescent discharge tubes 7 and consequently effect sequential starting of the fluorescent discharge tubes 7. Thus, the starting device is enabled to start the plurality of fluorescent discharge tubes 7 with the aid of one set of power source and rectifier 16.

Now, a typical starting device as one embodiment of the present invention which is configured as described above will be described in detail below with reference to FIG. 7.

Figure 7:
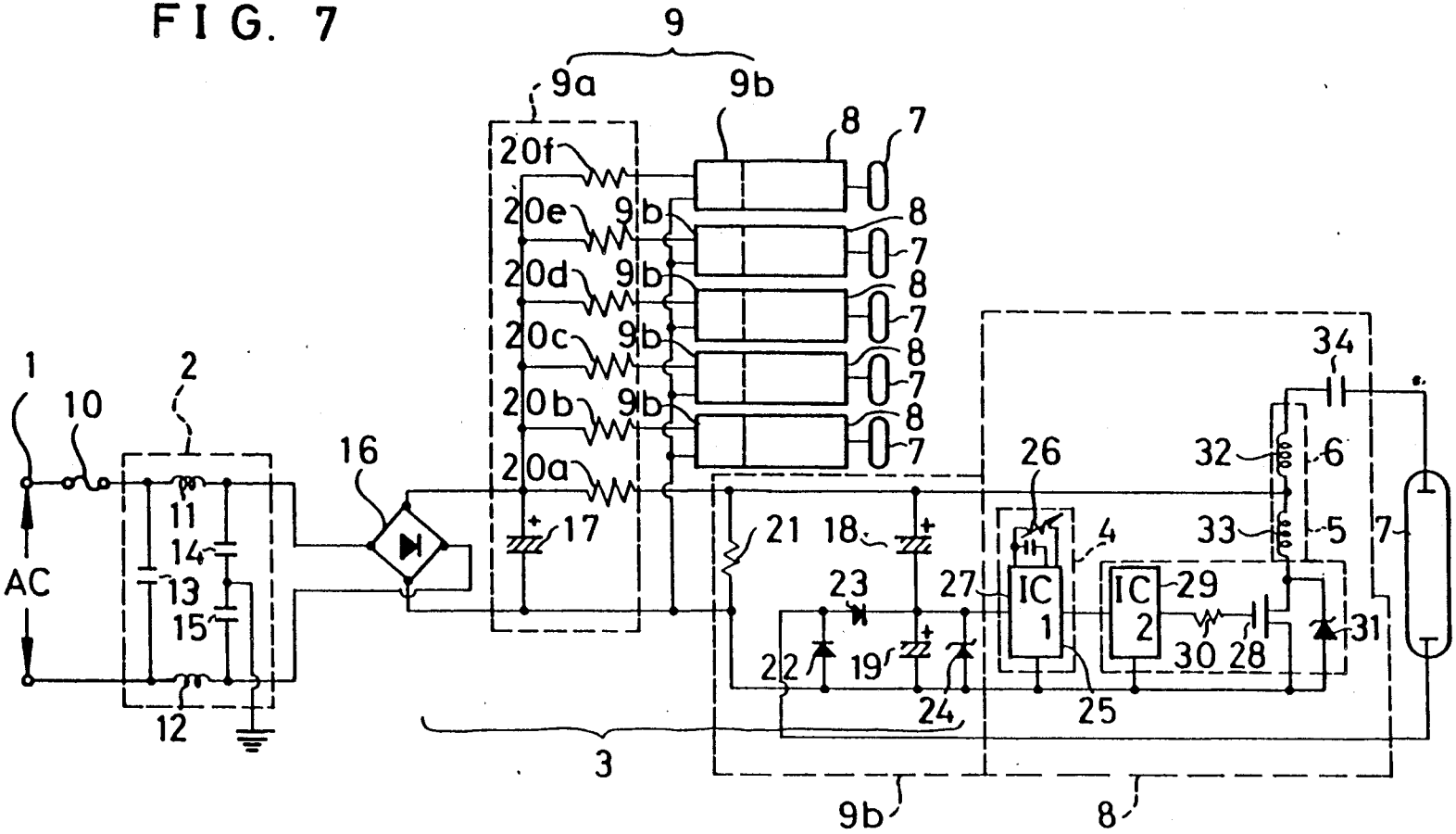
FIG. 7 is a diagram illustrating circuits which make up the starting device for a discharge tube as the second embodiment of the present invention.

FIG. 7 is a diagram illustrating a concrete circuitry of the starting device of this invention, designed to start six fluorescent discharge tubes. In the circuitry illustrated in FIG. 7, the noise killer 2, the rectifier 16, and pulse generating part 4, the switching part 5, and the high-voltage generating part 6 are identical to those of the circuitry described in the preceding embodiment and, therefore, are omitted from the following detailed description.

First, the noise killer 2 in the form of a bandpass filter is connected to the AC power source 1 through the medium of the fuse 10. This noise killer 2 is adapted to deprive the AC voltage received from the AC power source 1 of the noise such as high-frequency waves and supply the noise-free AC voltage to the rectifier 16.

To this rectifier 16 is connected the sequential potential forming part 9 which is composed of a circuit **9*a* and circuits 9*b*. The high-voltage applying parts 8 which are composed of the pulse generating part 4, the switching part 5, and the high-voltage generating part 6 described in the preceding embodiment and are each adapted to apply high voltages to the fluorescent discharge tubes are connected to the sequential potential forming part 9. The rectifier 16 and the sequential potential forming part 9 jointly correspond to the smooth rectifier part 3** of the preceding embodiment.

The circuit **9*a* is composed of a capacitor 17 (about 680 μF) for smoothing the ripple-rich DC voltage which has undergone the all-wave rectification effected by the rectifier 16 and resistors 20*a* to 20*f* of different values of resistance adapted to inhibit the adverse effects of the rush current and, at the same time, effect sequential actuation of the pulse generating parts 4. The circuits 9*b* are each composed of the bleeder resistor 21, the capacitors 18 and 19 for forming the split voltages to be described more specifically hereinafter, the rectifying diodes 22 and 23, and the constant-voltage diode 24**.

The capacity of the capacitor 17 is to be set preparatorily, depending on the number of fluorescent discharge tubes 7 given to be started.

The DC voltage issued from the rectifier 16 is mainly smoothed by the rectifying capacitor 17. The capacitors 18 and 19 play the role of producing the voltage for application to the pulse generating part 4. In other words, to the pulse generating part 4, the prescribed split voltage which is determined by the capacitors 18 and 19 is applied when the potential at the output terminal of the capacitor 19 equals the split voltage. The pulse generating part 4 is adapted to be prevented by the constant-voltage diode 24 from exposure to unduly large voltage and to be actuated on application of this split voltage.

The resistors **20*a* to 20*f* are parallelly connected to the (+) terminal of the capacitor 17. To these resistors are connected identical circuits 9*b* and the aforementioned high-voltage applying parts 8. The magnitudes of resistance of the resistors 20*a* to 20*f* are set at levels different from one another so that the DC voltage rectified by the rectifier 16 and the capacitor 17 is forwarded in the form of currents of magnitudes corresponding to the respective magnitudes of resistance to the capacitors 18 and 19. In other words, the resistors 20*a* to 20*f* possessing severally different magnitudes of resistance and the capacitors 18 and 19 of one equal capacity jointly form time constants different from one another. The aforementioned split voltages are consequently applied, with delays (interval of several milliseconds) corresponding to the respective time constants, to the pulse generating parts 4. The pulse generating parts 4 are actuated in the order corresponding to the respective time constants, i.e. the order conforming to that of the magnitudes of resistance of the resistors 20*a* to 20*f***.

In consequence of the introduction of such split voltages into the pulse generating part 4, the pulse generator 4, the switching part 5, and the high-voltage generating part cooperate to start the fluorescent discharge tubes 7 as described in the preceding embodiment. The fluorescent discharge tubes 7, accordingly, are sequentially started in the order in which the pulse generating parts 4 are put to work.

The starting device of the present invention which is configured as described above operates as follows.

The AC voltage deprived of noise by the noise killer 2 is transformed by the rectifier 16 and the capacitor 17 into a smoothed DC voltage and supplied to the resistors **20*a* to 20*f*. Then, by these resistors 20*a* to 20*f* and the capacitors 18 and 19 of the circuit 9*b*, the split voltage are sequentially applied to the astable multivibrators 25 forming the pulse generating parts 4 of the respective high-voltage applying parts 8. The astable multivibrators 25 are actuated sequentially in the order of application of the split voltages and consequently caused to feed the high-frequency pulses of the frequency determined by the set magnitudes of resistance of the variable resistors 26 and the capacity of the capacitor 27 to the FET driving IC 29 forming the switching part 5**.

The FET driving IC 29 imparts a switching motion synchronized with the high-frequency pulses to the field effect transistor 28. The fluorescent discharge tubes 7 are started by the switching motion inducing the automatic transmitter 6 to issue a high voltage.

In accordance with the DC voltage formed by the rectifier 16 and the capacitor 17, the resistors **20*a* to 20*f* and the capacitors 18 and 19 apply the split voltages sequentially with time delays to the respective pulse generating parts 4 and, by consequently actuating the pulse generating parts 4 sequentially, effect sequential start of the six discharge tubes 7**. Thus, the starting device is enabled to start the plurality of discharge tubes by the use of a single power source and a single rectifying circuit. When the starting device of this invention is used in starting a plurality of fluorescent discharge tubes, the effect of reducing the weight and volume of the starting device is attained in addition to the effect already mentioned with respect to the preceding embodiment. Thus, the plurality of fluorescent discharge tubes can be started very economically.

Further, by conferring upon the smooth capacitor 17 a large capacity commensurate with the number of the fluorescent discharge tubes 7, the smooth rectifying part 3 is allowed to decrease the ripple attendant upon the DC voltage being supplied to the pulse generating part 4 and, at the same time, lengthen the time for discharge of the capacitor 17. As the result, the power can be supplied stably to the fluorescent discharge tubes 7 and the pulse generating parts 4, and the fluorescent discharge tubes 7 can be started with enhanced stability.

The inventor's comparison between using the conventional starting devices one each for a plurality of discharge tubes and using the starting device of the invention for a plurality of discharge tubes has revealed that the starting device of the present invention reduces the weight to 1/10, the volume to ⅓, and the power consumption to 2/5.

The present embodiment has been described as setting the magnitudes of resistance of the parallelly connected resistors at levels different from one another and setting the capacities of the capacitors for determining the voltages applied to the pulse generating parts corresponding to the discharge tubes at one and the same level. This invention need not be restricted to this combination of the magnitudes but may be altered to have the magnitudes of resistance set at a fixed level and the capacities of the capacitors at levels different from on another so that the pulse generating parts will be put to operation sequentially.

What is claimed is:

1. A starting device for a discharge tube, comprising rectifying means connected to an AC power source and adapted to transform an AC voltage of said AC power source into a stable DC voltage, pulse generating means driven by the DC voltage issued from said rectifying means and adapted to issue high-frequency pulses of a fixed duty ratio, adjusting means for altering the frequency of the pulses issued from said pulse generating means, high-voltage applying means for applying high voltage to said discharge tube, and switching means for driving said high-voltage applying means synchronously with the high-frequency pulses issued from said pulse generating means.

2. A starting device according to claim 1, wherein said adjusting means is composed of a variable resistor and a capacitor and, consequently, the frequency of pulses issued from said pulse generating means is adjusted by varying the magnitude of resistance of said variable resistor.

3. A starting device according to claim 1, wherein said pulse generating means is adapted to issue high-frequency pulses having a duty ratio of 50%.

4. A starting device for a discharge tube, comprising rectifying means connected to an AC power source and adapted to transform an AC voltage of said AC power source into a stable DC voltage, sequential potential forming means for sequentially producing at a plurality of output terminals stated potentials with time constants different from one another, in accordance with the DC voltage issued from said rectifying means, and a plurality of high-voltage applying means connected severally to said output terminals and adapted to apply high voltages severally to a plurality of discharge tubes when the potentials of said output terminals equal said stated potentials.

5. A starting device according to claim 4, wherein said high-voltage applying means is composed of a pulse generating circuit driven by the DC voltage issued from said rectifying means and adapted to issue high-frequency pulses of a fixed duty ratio, an adjusting circuit for altering the frequency of pulses issued from said pulse generating circuit, a high-voltage applying circuit for applying a high voltage to a discharge tube, and a switching circuit for driving said high-voltage applying circuit synchronously with the high-frequency pulses issued from said pulse generating circuit.

6. A starting device according to claim 5, wherein said adjusting circuit is composed of a variable resistor and a capacitor and, consequently, the frequency of pulses issued from said pulse generating means is adjusted by altering the magnitude of resistance of said variable resistor.

7. A starting device according to claim 5, wherein said pulse generating circuit is adapted to issue high-frequency pulses of a duty ratio of 50%.

8. A starting device according to claim 4, wherein said sequential potential forming means is composed of a plurality of resistors possessing magnitudes of resistance different from one another and a plurality of capacitors of one fixed capacity connected one each to said resistors.

9. A starting device according to claim 4, wherein said sequential forming means is composed of a plurality of capacitors possessing capacities different from one another and a plurality of resistors of one and the same magnitude of resistance connected one each to said capacitors.

* * * * *

UNITED STATES PATENT AND TRADEMARK OFFICE

CERTIFICATE OF CORRECTION

PATENT NO. : 4,999,546

DATED : Mar. 12, 1991

INVENTOR(S) : Yoshiharu Koda, Tadashi Takashima

It is certified that error appears in the above-identified patent and that said Letters Patent is hereby corrected as shown below:

Drawings, Sheet 1, Fig. 1, No. 3; "Rectifer" should read -- Rectifier --.
Column 1, line 51; "requires" should read -- require --.
Column 7, line 4; "adJustment" should read -- adjustment --.
Column 10, line 20; "severally" should read -- several --.
Column 11, line 34; "on" should read -- one --.

Signed and Sealed this

Sixth Day of October, 1992

*Attest:*

DOUGLAS B. COMER

*Attesting Officer*

*Acting Commissioner of Patents and Trademarks*